US005439704A

United States Patent [19]

Sankaran et al.

[11] Patent Number: 5,439,704

[45] Date of Patent: Aug. 8, 1995

[54] COMBINED COIL AND BLANK POWDER COATING

[75] Inventors: Subbiah Sankaran, Riverside; Axel W. Missing, Moreno Valley, both of Calif.

[73] Assignee: Hunter Engineering Company, Inc., Riverside, Calif.

[21] Appl. No.: 143,864

[22] Filed: Oct. 27, 1993

[51] Int. Cl.[6] ..... B05D 3/02; B05D 7/26

[52] U.S. Cl. ..... 427/195; 427/471; 427/482; 427/178; 118/42; 118/235; 118/236; 118/310; 118/324; 118/325

[58] Field of Search ..... 118/235, 236, 324, 325, 118/40, 42, 308, 310; 427/471, 482, 178, 195

[56] References Cited

U.S. PATENT DOCUMENTS

| | | |
|---|---|---|
| 2,263,158 | 11/1941 | Benton . |
| 3,396,699 | 8/1968 | Beebe et al. . |
| 3,439,649 | 4/1969 | Probst et al. . |
| 3,449,705 | 6/1969 | Chamberlin . |
| 3,560,239 | 2/1971 | Facer et al. . |
| 3,575,138 | 4/1971 | Austin et al. . |
| 3,673,982 | 7/1972 | Rutledge et al. . |
| 3,742,903 | 7/1973 | Wheaton . |
| 3,866,571 | 2/1975 | Austin et al. . |
| 4,051,809 | 10/1977 | Zickar et al. . |

(List continued on next page.)

FOREIGN PATENT DOCUMENTS

| | | |
|---|---|---|
| 0041482 | 12/1981 | European Pat. Off. . |
| 4225235A1 | 2/1994 | Germany . |

OTHER PUBLICATIONS

International Search Report from PCT/US94/11272.

Database printout of applications owned by SFB Spezial Filter & Analagenbau GmbH including *English Abstracts* of DE 4225235, DE 4203948, and DE 4119932.

Dale Thompson, "Powder Coil Coating—A Technology Ready To Roll," *Powder Coating* Feb. 1993.

"Powder-Coated Coil, Resino PC", Kawasaki Seitetsu (Kawatetsu) Galvanizing Company, Ltd., Product Brochure, Circa 1986.

"Powder-Coated Galvanizing Steel Sheet 'Resino Lithin'", Takata, et al., Kawatetsu Galvanizing company, Ltd. Publication, vol. 18, No. 3, 1986.

"Onoda Electro Powder Dynamics", Customer Reference for Onoda Powder-PCM System, Jun. 1, 1987.

"Manufacturing Method and Properties of Electrostatic Powder Coated Galvanized Steel Sheet", Takata, et al., Kawatetsu Galvanizing Company, Ltd. Publication, Oct. 20, 1988.

Untitled Paper regarding Powder Coated Skin Roughness, pp. 87–88 and 222–223, Circa 1990.

"Table of Powder Coating Wide Coil Lines", source unknown, Circa 1991.

(List continued on next page.)

*Primary Examiner*—Chester T. Barry

*Attorney, Agent, or Firm*—Knobbe, Martens, Olson & Bear

[57] ABSTRACT

A powder coating line for coating either coiled strip or pre-sheared and punched blanks is provided. In order to coat strip a catenary portion of the strip is suspended through a powder coating subsystem which includes a powder coating booth and a curing oven. The coated strip is the recoiled onto a rewind reel. In the alternative, the strip may be stopped and sheared at an input region and presheared blanks introduced to the powder coating subsystem. The blanks are placed on a belt conveyor, which transports them into the powder coating booth. The blanks are then passed in a conveyor through the powder coating booth and over for subsequent restacking. After passing out of the oven, and before coiled or stacking occurs, the strip or blanks pass through a quench and an air dryer. The powder coating subsystem can be incorporated into a larger pre-treating, cleaning, embossing or post-processing line.

6 Claims, 12 Drawing Sheets

U.S. PATENT DOCUMENTS

| | | | |
|---|---|---|---|
| 4,167,150 | 9/1979 | Davis et al. . | |
| 4,210,682 | 7/1980 | Davis et al. | 427/178 |
| 4,244,985 | 1/1981 | Graff et al. . | |
| 4,325,982 | 4/1982 | Gillette et al. . | |
| 4,338,364 | 7/1982 | Kennon et al. . | |
| 4,407,867 | 10/1983 | Brück et al. | 118/235 |
| 5,059,446 | 10/1991 | Winkle, Sr. et al. . | |
| 5,176,755 | 1/1993 | Winkle, Sr. et al. . | |
| 5,228,920 | 7/1993 | Thompson, III | 118/236 |
| 5,382,450 | 1/1995 | Salisbury | 118/324 |

OTHER PUBLICATIONS

"Table of Powder Coating Wide Coil Lines", source unknown, Circa 1991.

"Nisshin's New Super Tecstar Line", Nisshin Steel Company Limited Publication, Engineering Activities Section, date unknown.

"Compilation of Coil Powder Coating Line Lectures Given in Hamburg Oct. 7–8, 1991 and ECCA seminar in Brussels Nov. 25–26, 1991", Meuthen, *Stahl und Eisen* (Steel and Iron), vol. 12, No. 4, pp. 67–69, 1992.

* – FUNCTIONS NOT PERFORMED ON COMBINATION LINE

COMBINED COIL AND BLANK POWDER COATING

FIELD OF THE INVENTION

The present invention relates generally to an apparatus for applying a coating on continuously moving sheet metal, and, more particularly, to an apparatus which can alternately coat sheet metal in either coil or blank form.

BACKGROUND OF THE INVENTION

Conventional liquid roller coating lines using coil-to-coil transfer of metal strip from the unwind reels to the rewind reels, apply solvent or water-based paints, lacquers and coatings to the strip through the use of reverse or forward roller coating machines or similar application devices. The "wet" strip is then passed through catenary, flotation or combination catenary/-flotation ovens for driving through a cross-linking process. Environmental regulations, however, which have become more stringent in the past two decades, now require the containment and disposal of such solvents. Thus, costly solvent containment and incineration systems for eliminating the volatile organic compounds in the paint have to be utilized in conjunction with these coating processes. Moreover, there is a finite limit to the thickness of coating that can be applied using this method. Further, appearance problems often arise when the paint is rolled onto embossed surfaces.

Due to the aforementioned drawbacks of liquid roller coating lines, the technique of powder coating strip metal has been developed in the industry. Utilization of this technique normally involves applying electrostatically charged dry plastic powder to the strip, and then passing this strip with plastic powder through an oven where the powder is melted and cured through a cross-linking process.

These plastic powders have the advantage of including only a fraction of volatile solvents associated with liquid paints, and thus are environmentally friendly and do not require expensive incineration and recovery systems.

A number of devices for applying a powder coating to a coil of strip have been devised. Currently, devices exist which can transport the strip in coil form through the powder coating application apparatus at speeds of approximately 200 feet per minute, the maximum speed limited by the powder application rate of the powder coating application apparatus. Continuously powder-coated strip, though usable for many applications, has several drawbacks. In particular, problems arise when "blanks" are made from pre-coated coils. "Blanks" are sections of strip which have been processed, for example, by having edges sheared and holes punched in it. The punching of holes, and also the shearing of these blanks (thus creating "sheared blanks") from the coil leaves exposed sheared ends, edges and raw edges at the punched holes where special rust prevention is often particularly necessary when the blank is used in the design and formation of commercial products. Special rust protection is especially critical if the finished product is subjected to high humidity, such as in coastal regions, to prevent "filiform" rust and ensure the integrity of the coating. Other examples of powder coating continuous elongated articles (such as wires) prior to punching and forming are shown in U.S. Pat. Nos. 3,439,649, 3,560,239, 3,396,699, 4,244,985 and 4,325,982.

Processes and apparatusses for forming a plastic coating on a metal strip are known. These processes normally include the steps of applying electrostatically charged powder to the strip within an enclosed chamber, heating the strip rapidly with an induction heater to melt the powder, and then maintaining the temperature of the coated strip to above the melting point of the plastic powder for a certain period of time before quenching. These coating lines can optionally include a press which pre-punches a strip into a continuous series of blanks, the pre-punched strip being passed through the powder coating and heating steps before being cut into lengths by a shear. Because the shearing of the blanks occurs after coating, however, the ends of each blank are left as unprotected, exposed raw metal. Detrimentally, these exposed sheared ends are likely to be subjected to corrosive elements when the blank is formed into a part and utilized in a commercial product. This is due to the fact that the ends of the blank are typically bent around to form a rounded edge during part formation, such that the raw end surfaces are typically proximate the exterior of the product. Furthermore, corrosion in these areas will become visible sooner than any untreated surfaces in the interior of the part.

Complete powder coating of already formed parts is known, however, the line speed must be extremely slow to ensure that the parts, which must be hung from a moving conveyor, are completely covered. An improved, faster technique for the powder coating of pre-sheared and punched blanks has been incorporated in some processing lines outside the United States. These machines have the advantage that the entire pre-sheared and punched blank may be chemically treated and powder coated one side at a time, including the sheared ends and punched holes. These coated blanks are then formed into parts after the powder coating operation. This type of chemical pre-treatment and powder coating of the entire blank provides rust protection throughout the part, including its edges. Such protection is, as in certain household appliances, such as refrigerators and washing machines, mandatory to prevent "filiform" rust. The coating speed of these machines is disadvantageously limited, however, by the speed at which the conveyed pre-sheared blanks may be unstacked and restacked. Currently, the maximum line speed attained is approximately 50 feet per minute, especially when long blanks, such as those used for refrigerator wrappers or the like, are being used.

SUMMARY OF THE INVENTION

The present invention fills a void in the coating line industry by providing a combined coil and blank powder coating process line. With this process line, a coating manufacturer has the capability of coating strips at relatively high production speeds to form pre-coated strips useful for end-use applications that either are not subject to "filiform" rust or where protection from such corrosion is not required. In addition, the coating manufacturer has the option of coating pre-sheared and punched blanks with the same coating line, and with only minor modifications, so as to obtain partially or completely protected blanked pieces. In short, the present combined powder coating process line provides the coating manufacturer with an extremely versatile machine that replaces two machines which were necessary before this time for performing the coil and blank coating operations singly.

In one embodiment, the present invention generally comprises a powder coating subsystem of an overall coating line, which also may incorporate entry and exit accumulators for continuous line processing, metal treatment sections, dry in-place chemical pre-treatment and/or embossing capabilities. In one mode, the coating line can run coil-to-coil pre-treat, using cleaning, rinsing and chemical treatment, and then run through the powder coating subsystem to coat one or both sides with powder at speeds which are limited only by the powder application equipment. The finished strip can either be coiled and sold as is, or sheared into specified blank sizes as the ultimate stage in the coating line. In a second mode, the coating line can run coil-to-coil pre-treat first, after which the coils are taken away from the coating line to a blanking line and then brought back as pre-treated blanks for subsequent powder coating and curing. This mode results in partial corrosion protection of the untreated edges by applying the powder coat thereto. Optionally, the sheared edges and punched holes may be treated with chemicals after blanking but prior to powder coating and curing. And in a third mode, the present invention can operate as an independent powder coating line, starting with either pre-treated blanks or pre-treated coils, which may be then blanked for final single-side powder coating. This mode differs from the first and second in that only the powder coating subsystem is utilized, the articles to be coated being supplied and pre-treated, if necessary, by an outside source.

The combined powder coating subsystem generally comprises an input region, a powder coating booth having a plurality of powder coating application spray devices or guns, a melting and curing oven, a quench, and an output region. When processing coils, the coil strip is suspended between a pair of pinch rolls at the input region and a catenary roll in the quench. The coil strip thus forms a catenary through the powder coating booth and oven over a series of conveyors for transferring blanks along the same path. The strip exits the quench and traverses a span across the exit region on a threading table/water trough before being fed through a pair of squeegee rolls and a hot air dryer.

When the powder coating subsystem is processing blanks, a movable pallet or unstacker is positioned adjacent to an entrance belt conveyor within the input region. A transfer mechanism moves the uncoated blanks one at a time from the unstacker to the belt conveyor, which feeds the blanks into the powder coating booth. Prior to the blanks commencing travel through the powder coating booth, the powder coating application devices or guns are adjusted from their strip coating positions into new positions for coating the blanks. Additionally, a skate wheel-type conveyor is shifted from under the belt conveyor into the powder coating booth to provide support and motive force to the blanks through the booth. The blanks travel through the powder coating booth and onto an oven conveyor which moves the blanks through the melting and curing stages of the oven. The oven conveyor continues through the water quench and a pair of hot air dryers to deposit the blanks onto an exit stacking device. The stacking device, such as a split conveyor, vacuum-cup or flotation stacker, disposed underneath the threading table/water trough, stacks the blanks for removal. preferably, the stacker is sized to receive one or more side-by-side stacks of blanks and arranged to shift laterally within a well underneath a split conveyor. Once a number of coated blanks are placed on one side of the stacker, the stacker shifts to present an empty side underneath the split conveyors ready to receive more coated blanks. The first stack of coated blanks is then accessible to a transfer mechanism, which unloads the blanks from the well to a waiting cart or truck.

DESCRIPTION OF THE PREFERRED EMBODIMENTS

Coating Line

Figure 1:
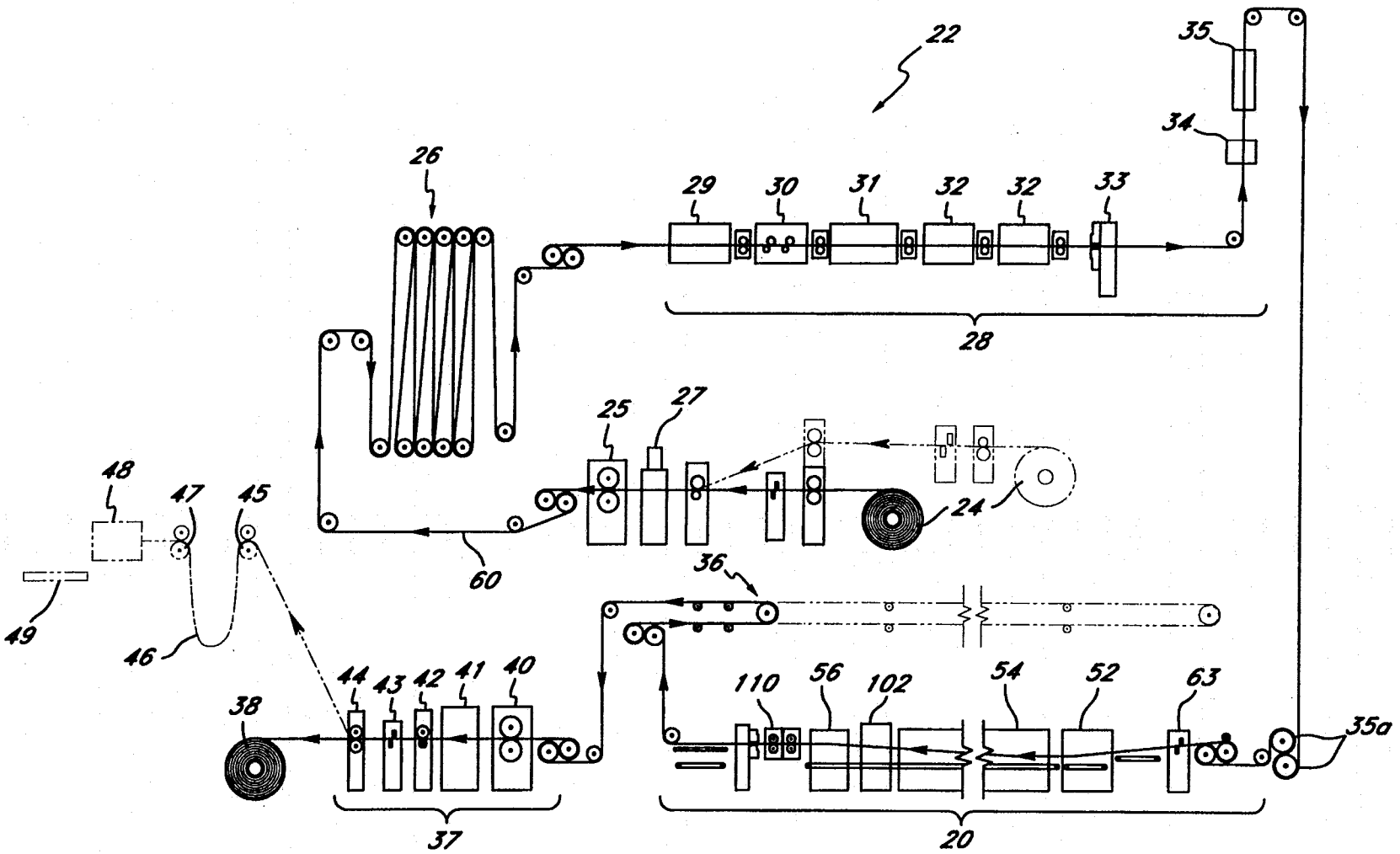
FIG. 1 is a schematic view of a complete strip metal processing line, including a combined coil and blank powder coating subsystem.

In FIG. 1, a combined coil and blank powder coating subsystem 20 is shown incorporated into an overall coating line 22. In one mode of operation, the entire coating line 22 can accomplish coil-to-coil or coil-to-blank strip cleaning, pre-treating and coating in a single continuous operation. Initially, a pair of payoff reels 24 alternately supply metal strip 60 to be treated and coated to the coating line 22. The strip 60 passes through a joiner 27 and optionally through a pre-embosser 25, and thereafter through an entry accumulator 26, prior to entering a pre-treatment region 28. The pre-treatment region 28 may comprise one or more of the following: a cleaning chamber 29, a brush cleaning station 30, a second cleaner 31, one or more hot or cold water rinses 32, an air knife 33, and a dry-in-place chemical treatment roll coater 34 or a chemical reaction cell located prior to rinse 32, dryer 35, and possibly even a cooling roll 35a. The strip 60 is preferably threaded through these various apparatuses by means of conventional pinch rolls, tension bridles, turn rolls and steering rolls. Other cleaning and pre-treatment steps are possible in the coating line 22, depending on the specific application.

After cleaning and pre-treating, the strip 60 preferably passes through the combined powder coating subsystem 20. After exiting the subsystem 20, the strip 60 preferably passes through an exit accumulator 36, and is then guided through a post-coating processing region 37 and wound onto one or more rewind reels 38. The optional post-coating processing region 37 may include a post-embosser 40 and a cold laminator 41. The post-coating region also includes a pinch roll 42, an exit shear 43, and a pinch/breaker roll Other post-coating processing steps are possible.

In some cases, a manufacturer may choose to shear the coated strip into blanks rather than winding onto a reel 38. As shown with a dashed line in FIG. 1, the strip may be diverted away from the reel 38 and around a first press feed roll 45. The strip descends down to a slack or take-up loop 46 and up over a second press feed roll 47 before entering a blanking shear 48. The blanking shear 48 is a conventional four-sided press which trims the coated strip to a preferred configuration on all sides. Inside the blanking shear 48, a stop (not shown) halts the advancing strip in order to perform the shearing operation. When the strip is halted within the blanking shear 48, the take-up loop 46 increases in length as the strip continues to run through the overall coating line 22. After a blank is sheared, it is dispensed onto a stacker 49 and the strip allowed to advance further into the blanking shear to cut a second blank. At this time, the take-up loop 46 decreases in length as the strip continues into the blanking shear 48. Of course, rather than diverting the strip to perform this blanking operation, the components 45–49 may be mounted on a movable platform and substituted for the rewind reel 38. Depending on the length of the blanks being sheared, and the speed of the coating line 22, between 10–30 blanks may be sheared per minute, for example.

As mentioned above, the coil-to-coil treating and coating operation may be performed and the pre-coated coils sold to outside sources for further processing or fabricating. However, the combined powder coating subsystem 20 can accommodate strip in both coil and pre-sheared blank form. Thus, the coating line 22 may be interrupted between the pre-treatment region 28 and the powder coating subsystem 20, and the pre-treated coil run through a blanking and punching line (which may be off-site). At the discretion of the end user, the punched and/or sheared blanks may be further treated to coat any raw edges with chemical treatment subsequent to the blanking operation. The partially or completely treated pre-sheared blanks may be then input into the powder coating subsystem 20 to receive a coat of powder on one or both (one at a time) sides. At the end of the powder coating step, the pre-sheared blanks are removed from the subsystem 20 without need for the post-coating processing region 37 or rewind reel 38.

Combined Coil and Blank Powder Coating Subsystem

Figure 2:
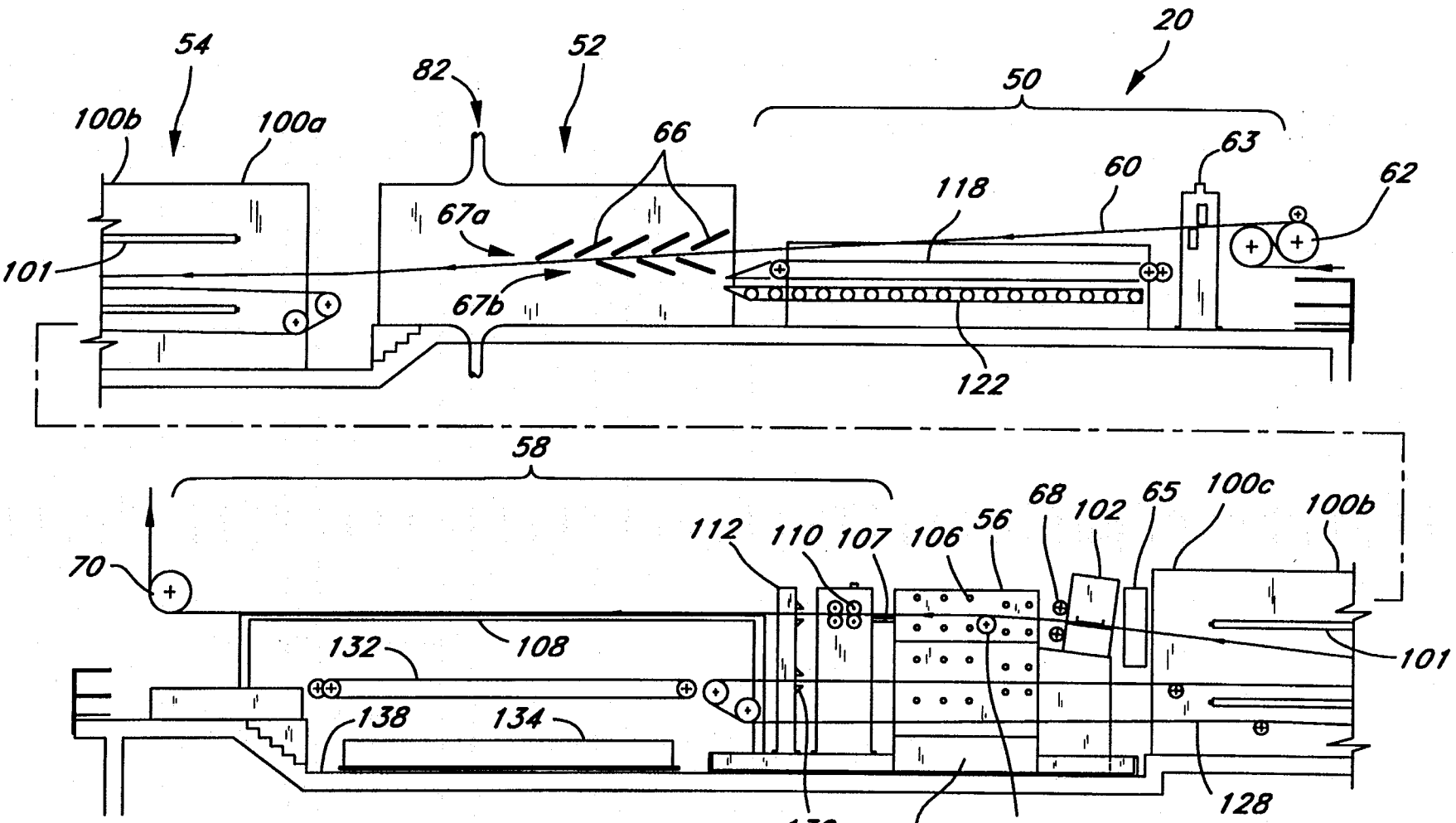
FIG. 2 is a side elevational view of the combined powder coating subsystem during processing of a coil.
Figure 4:
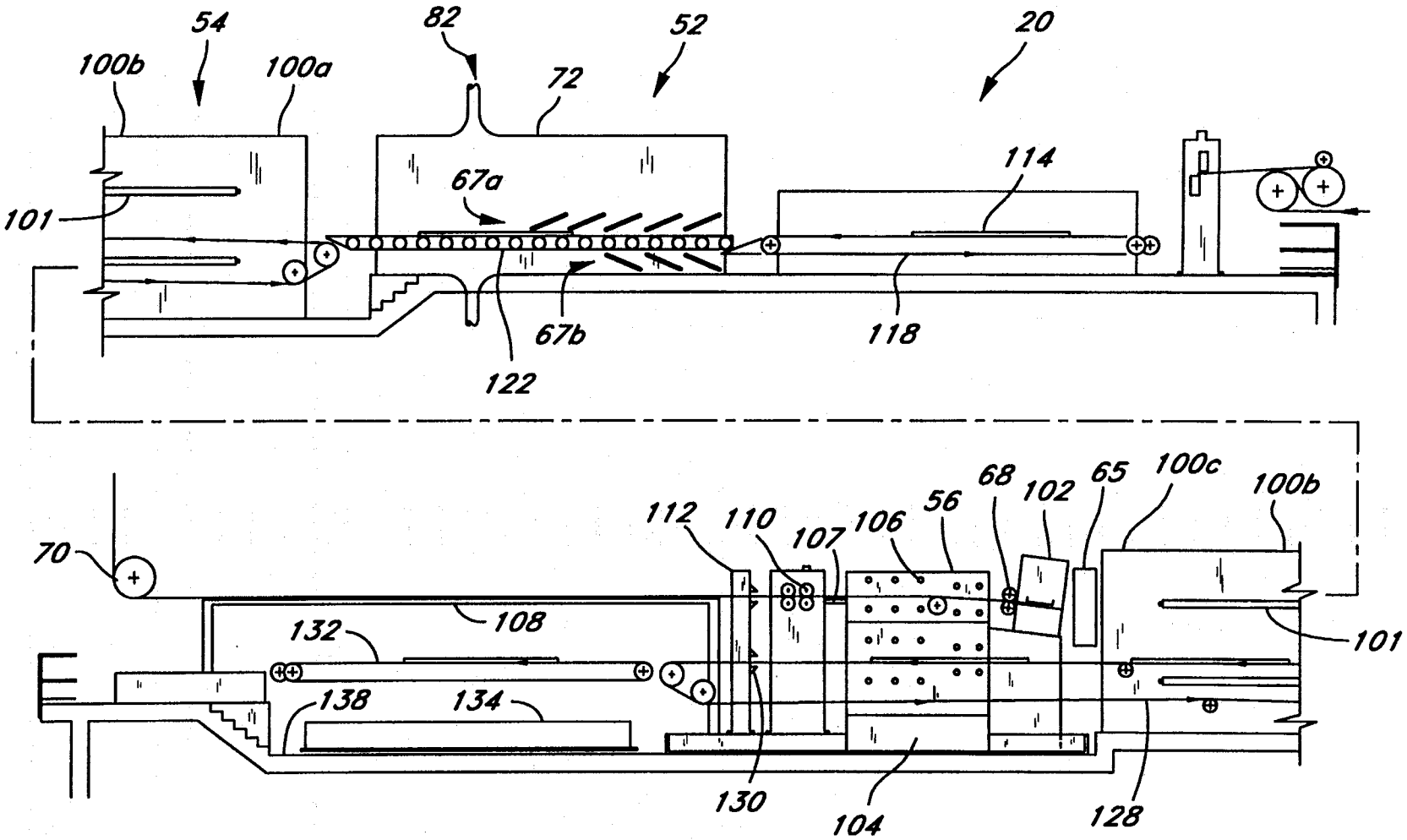
FIG. 4 is a side elevational view of the combined powder coating subsystem in the process of coating a series of pre-sheared and punched blanks.

The combined powder coating subsystem 20, shown in FIGS. 2 and 4, generally comprises an input region 50, a powder coating chamber or booth 52, an elongated heating chamber or oven 54, a quench 56 and an output region 58. When coil strip 60 is being processed, as in FIG. 2, the strip is suspended through the powder coating booth 52 and oven 54 between a pair of entrance rolls 62 and a catenary roll 64. The strip 60 thus is suspended between these entrance and exit points in a catenary shape above a series of conveyors; the conveyors being used to transport blanks through the powder coating subsystem 20, as will be discussed below.

The strip 60 first passes through the powder coating booth 52, which is substantially enclosed and includes a plurality of plastic powder application spray devices or guns 66. An upper bank **67*a* and a lower bank 67*b* of guns 66, preferably in row form, are mounted in the booth 52 above and below the strip 60 to allow both the top and bottom surfaces of the strip to be coated. The coated strip 60 then passes into the oven 54, which is relatively long to provide time to cure the plastic powder into a coating, the powder typically a thermoset such as a polyester hybrid. The coated strip 60 then passes through the pair of exit pinch rolls 68 (which are open during strip processing) and over the catenary roll 64 and through the quench 56, which cools the strip and coating to a temperature low enough for subsequent elastomeric covered steering rollers 70** to handle.

Powder Coating Booth

Figure 3:
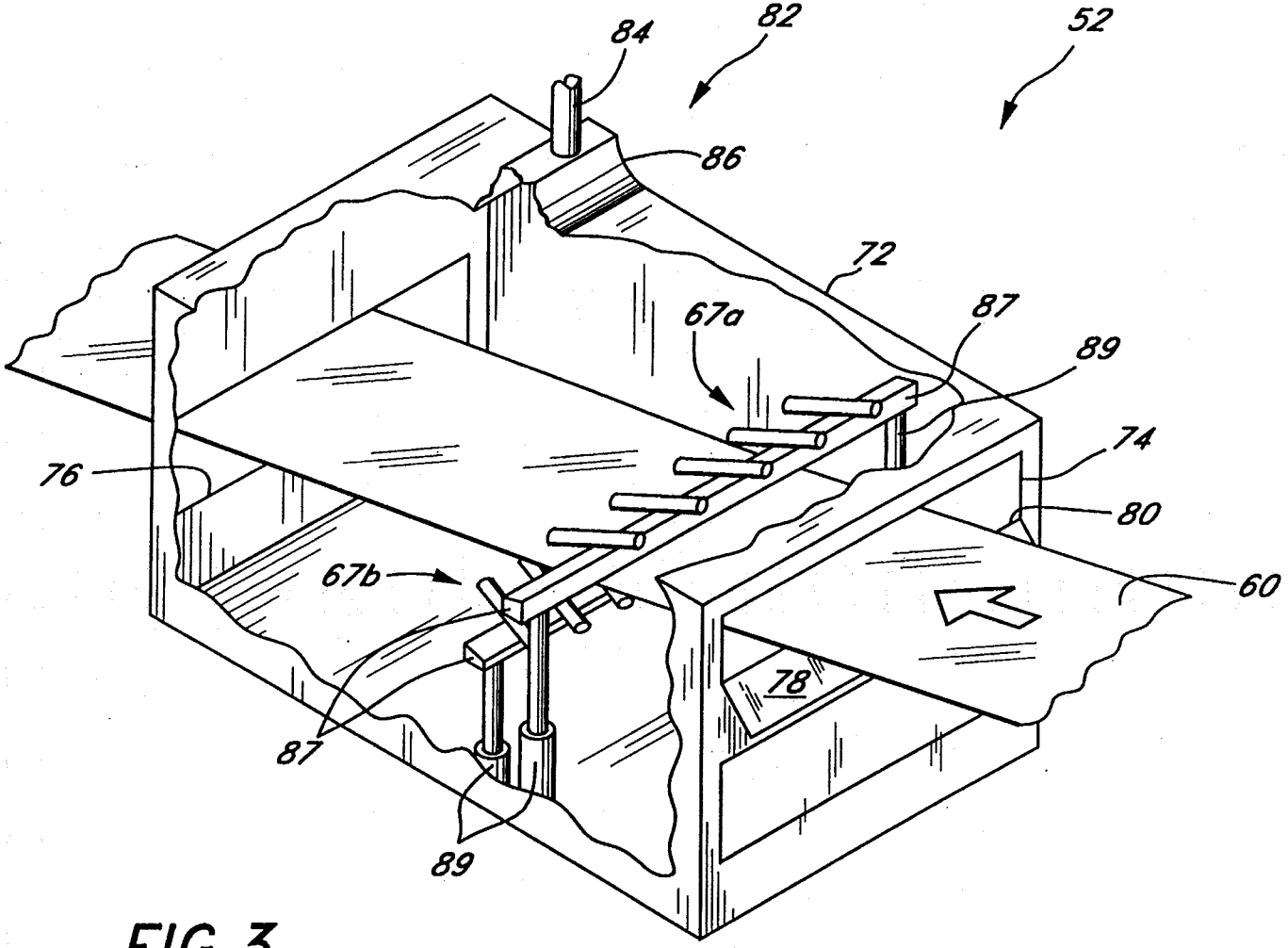
FIG. 3 is a partially cutaway perspective view of a powder coating booth during processing of a coil.

Now with reference to FIG. 3, the powder coating booth 52 is defined by a box-shaped outer housing 72 having a strip entrance aperture 74 and an exit aperture 76 at opposite ends, the entrance and exit apertures 74, 76 being sized to provide room for the strip 60 to pass yet minimizing extra clearance so as to reduce both the amount of powder which can escape from the booth therethrough, and the amount of air turbulence at said entrance. The strip entrance aperture 74 additionally includes a closable door 78 pivoting on an elongated hinge-line 80 which allows the aperture 74 to be closed when the powder coating booth 52 is being used to coat blanks, as will be described below.

Preferably, the powder coating booth 52 includes an exhaust system 82 having one or more exhaust ducts 84 communicating with the interior of the booth 52 via a hood assembly 86 located downstream of the spray guns 66 along the booth. In the preferred embodiment, the hood assembly 86 extends around all four sides of the powder coating booth housing 72 to maximize the amount of collected powder particles. It has been found that under certain operating conditions, a 99% efficiency rate in powder usage is possible due to the reclamation of fugitive powder. The positioning of the exhaust system 82 at this location creates a "curtain" of exhaust flow downstream of the powder coating application guns 66 so that the majority of powder which does not stick to the strip 60 is diverted into the exhaust system 82 prior to reaching the exit aperture 76. The exhaust system 82 is preferably located away from the point of application of the powder to the strip 60 reduces turbulent currents around the strip 60 in the area where the powder is applied. Close placement allows air currents to work counter to the forces between the powder and the strip 60.

Spray Guns

With reference to FIGS. 2 and 3, the powder coating application guns 66 are preferably connected to the booth 52 and located both above and below the strip 60. These guns 66 apply electrostatically charged powder to the vicinity of the strip, the powder being attracted to the strip surface due to the opposite charges. While the gun 66 may be mounted perpendicular to the direction of strip 60 travel this is not preferred. Preferably, the guns 66 are mounted at an angle such that they sit nearly parallel to the direction of strip 60 travel. Advantageously, this placement causes the powder to be expelled from the guns with a velocity component in the direction of movement of the strip. Because of the electrostatic attraction, it is advantageous to position the guns 66, and thus "aim" them, in such a manner as to facilitate the "landing" or attachment of the powder particles onto the moving strip 60. Pointing the guns 66 in the direction of the strip travel reduces the differential velocities between the discharged flying particles and the strip 60, and encourages this "landing".

While there are banks of guns 66 both above and below the strip 60, in some applications, one of the upper or lower banks 67*a* or 67*b*, respectively, of powder coating application guns 66 may be removed or shut off in order to powder coat only one side of the strip 60. Typically, the lower bank 67*b* of guns is deactivated.

Figure 7:
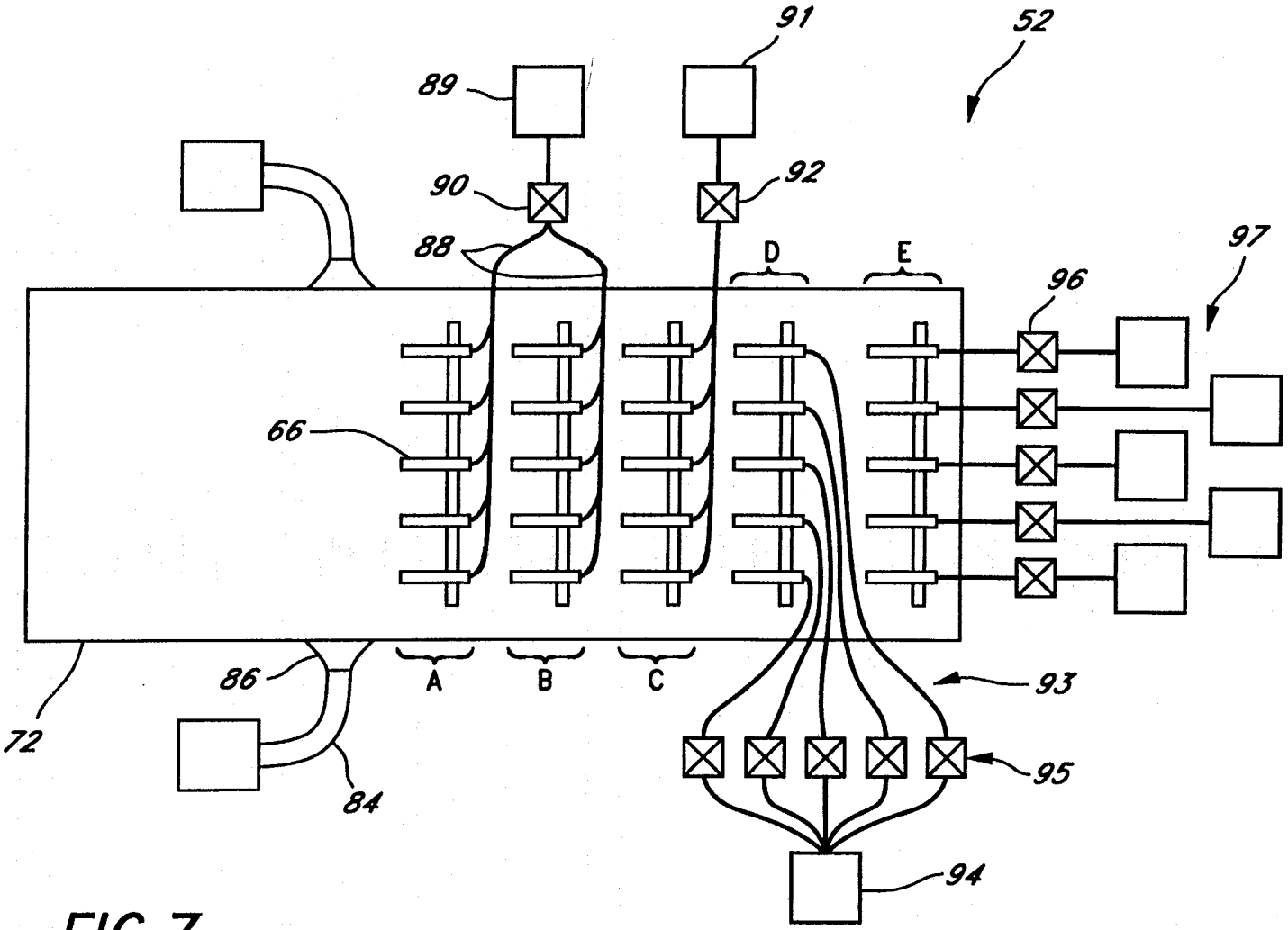
FIG. 7 is a schematic top plan view of the powder delivery system within the powder coating booth.

Depending on the width of the strip 60 being coated, one or more guns 66 may be mounted across the powder coating booth 52 in each row. In one embodiment, each row of guns 66 is supported on a cross member 87, which is vertically adjustable using an air cylinder or similar device 89 on either end. Thus, each cross member 87 assumes a substantially horizontal orientation across the width of the coating booth 52 and may be adjusted vertically independently of the other cross members in the other rows. Typically, and as shown in FIG. 7, there will be 5–10 guns across the powder coating booth 52 in each row. Also, depending on the amount of powder which is desired to be applied, there may be one or more rows of guns 66 spaced along the length of the entrance half of the powder coating booth 52.

In a preferred embodiment, there are a plurality of guns 66 located in a plurality of rows, the number and location of guns which are operating controlled automatically to compensate for strip width and thickness of powder coating required. In the preferred embodiment, there are five rows of guns 66 above the strip and three rows of guns below the strip.

While a variety of guns 66 may be utilized, two examples of preferred powder coating application guns are the Tribomatic II gun, manufactured by Nordson Corporation, and the Rotary Applicator, manufactured by Binks-Sames. Both guns require air to expel the plastic particles, the Binks-Sames gun using an electromagnetic field to charge the particles, while the Tribomatic II utilizes friction to charge the particles.

FIG. 7 schematically shows a number of different control possibilities for supplying and delivering pressurized powdered particles to the applicator guns 66. In rows A and B, each of the guns 66 is connected through a supply line 88 to a source 89, the flow of powder being controlled at a valve 90. Thus, a controlled amount of powder is supplied to each of the ten guns 66 in the two rows A and B, this flow rate being metered by the valve 90. Row C has a single supply source 91 and control valve 92 for all of the five guns therein. Row D includes supply lines 93, which are connected to a single supply source 94 through a plurality of valves 95, one for each gun. Finally, row E shows a valve 96 and supply source 97 for each gun 66 in the row, affording maximum control.

Melting and Curing Oven

Again referring to FIGS. 2 and 3, after the coated strip 60 exits the powder coating booth 52 through the exit aperture 76, the strip 60 enters the oven 54. The oven 54 first melts the powder particles of thermoset plastic on the moving strip 60, and then cures the melted particles into a coating. The length of the oven 54, the intensity of heat applied and the speed of strip 60 travel determines the amount of heat which is applied to the strip 60. During heating, the thermosetting particles first undergo a melting, fusing or gelling phase, then a de-gassing phase, and finally a curing phase. The exact dividing temperature lines between these phases is currently not well known. The melting phase is self-explanatory, while the de-gassing phase is a period where any moisture or other volatile substances are evaporated from the thermoset. The curing phase involves a process of cross-linking of the molecular chains of the thermosetting plastic to form the final hardened material properties. Although the specific interfaces between the phases are not well known, the amount of heat necessary to cure the powder is generally determined by the type of thermosetting plastic powder applied. The amount of heat to cure is typically supplied by the manufacturer of the plastic powder in the form of an amount of time a fixed heat source must be applied to the powder. In one example, a polyester hybrid is held within the oven for approximately 25-30 seconds at a temperature of 475° F. to ensure complete curing. Other thermosets may be used, for example, epoxy/urethane mixtures or the like.

The overall length of the heating oven 54 depends on several factors but, in the preferred embodiment, is approximately 85 feet (shown separated in FIGS. 2 and 4). A typical processing speed for coiled strip 60, which is limited at the present time by the capacity of the powder coating application guns 66, is approximately 200 feet per minute. At this speed, it will take a given point on the strip 60 approximately 25.5 seconds to travel through the oven. The particular length of the oven 54 may be changed dependent on the type of plastic powder applied to the strip and the desired curing cycle, as well as the speed of the strip and applied heat intensity or flux. In general, however, it is desired that the oven length be fixed, and that the speed of the processing line be maximized based on the fastest speed at which the application guns 66 can effectively apply powder. Given the maximum strip travel speed, the time in the oven 54 is fixed, and therefore the intensity of heat must be varied to provide the necessary melt and cure heat. Therefore, when utilizing various types of plastic powders, which may require more or less total energy or heat to cure, the heat intensity may be varied, or alternatively the line may be slowed. In order to vary the heat intensity, and as described below, there may be several different heating means along the length of the oven 54.

The heating means within the oven 54 may be one of several types. In the preferred embodiment, a plurality of infrared heating elements 101 are placed at least at the entrance portion 100*a* of the oven 54 to apply radiant heat to both sides of the strip 60. The particular infrared heaters used may be obtained from any number of well-known manufacturers and may be electric or gas-fired. These elements 101 are preferably narrow and placed in between the cables of a blank oven conveyor 128, which will be described in more detail below, in order that the conveyor 128 not interfere with the heating of the bottom of the strip 60. Toward the middle portion 100*b* of the oven 54, a combination of infrared elements and convection heating is preferably used. Further along the oven 54, proximate the exit portion 100*c*, only convection heating is preferably used. As illustrated in FIG. 2, there are thus generally three zones of heating within the oven: a first zone, generally 100*a*, in which only infrared heat is applied; a second zone, generally 100*b*, in which combination of infrared and convection heat is applied; and a third zone, generally 100*c*, in which only convection heating is applied. It has been found that convection heating produces a superior curing result due to the more even manner in which the heat is distributed over the plastic coating on the strip. Although convective heating is quite effective, it cannot be used at the entrance portion 100*a*, as the particles of plastic powder, which are only electrostatically held to the strip 60, are likely to be disturbed by the convection currents.

At present, the plastic powders cannot be heated too quickly, and therefore the coated strip 60 must remain in the oven for at least a specified minimum amount of time due. Therefore, the use of induction heating is not preferred, as it heats the powder too quickly and can induce unsightly discoloration of the plastic. However, as technology advances and new coating materials are developed, the total specified curing time may be reduced, and thus induction heating, which is much more rapid than either infrared or convection heating, may be utilized. Therefore, it is contemplated that an induction heater may be placed at the beginning of the oven 54 to rapidly increase the temperature of the strip 60 and surrounding coating prior to the strip continuing through the oven where the coating is fully cured. Ideally, in fact, the oven 54 may then incorporate induction heaters for pre-heating and initial melting, and then continue with one or both of convection or infrared heating. The heating configuration shown in FIG. 2 and described above, however, exemplifies the best solution for melting and curing current state of the powder materials, although this configuration is highly dependent on advances in powder material technology.

As seen in FIG. 2, after the strip 60 passes through the exit of the oven 54, it passes through a joiner 102 and then through the pair of pinch rolls 68. Then the strip 60 is passed through the quench 56, which quench 56 may comprise some type of water spray or applicator to rapidly cool the coated strip 60. Preferably, the quench comprises an outer housing 104 supporting a plurality of headers 106 having nozzles (not shown) which point towards the strip 60 for applying a cooling spray of water. The majority of the cooling water typically runs off the strip 60, and is therefore collected in a sump for reuse. Some types of coating materials or curing processes, however, require a more gradual cooling than that which occurs utilizing water. This may be accomplished with an air quench. Regardless of the type of quench, however, the temperature of the coated strip 60 is reduced to between 100°–120° F. This temperature is desired in order to prevent damage to subsequent elastomeric steering rollers, such as at 70, which handle the coated strip.

The coated and quenched strip 60 passes from the quench 56 across a threading support 107 and between a pair of squeegee rollers 110 which remove a majority of excess moisture. The support 107 is inclined slightly towards the quench 56 so that any excess water on the strip 60 is diverted back to the quench. The squeegee rollers 110 engage the strip 60 to squeeze off a majority of water as well as pull the strip through the powder coating subsystem 20. A hot air dryer 112, or blow-off knife, is provided after the squeegee rollers 110 to completely dry the strip 60. A threading table 108 bridges a gap between the dryer 112 and a steering roll 70. The finished coated strip is then passed over the steering roller 70 prior to post-coating operations.

When the strip 60 is initially threaded into the combined powder coating subsystem 20, the front portion of the strip 60 is guided through the joiner 102 and water quench 56 across the threading support 107 to the squeegee apparatus 110 and blower 112, and then across the threading table 108 to the steering roll 70. The threading support 107 and table 108 thus provide bridges across gaps between the quench 56, squeegee rollers 110 and steering roll 70.

Figure 9:
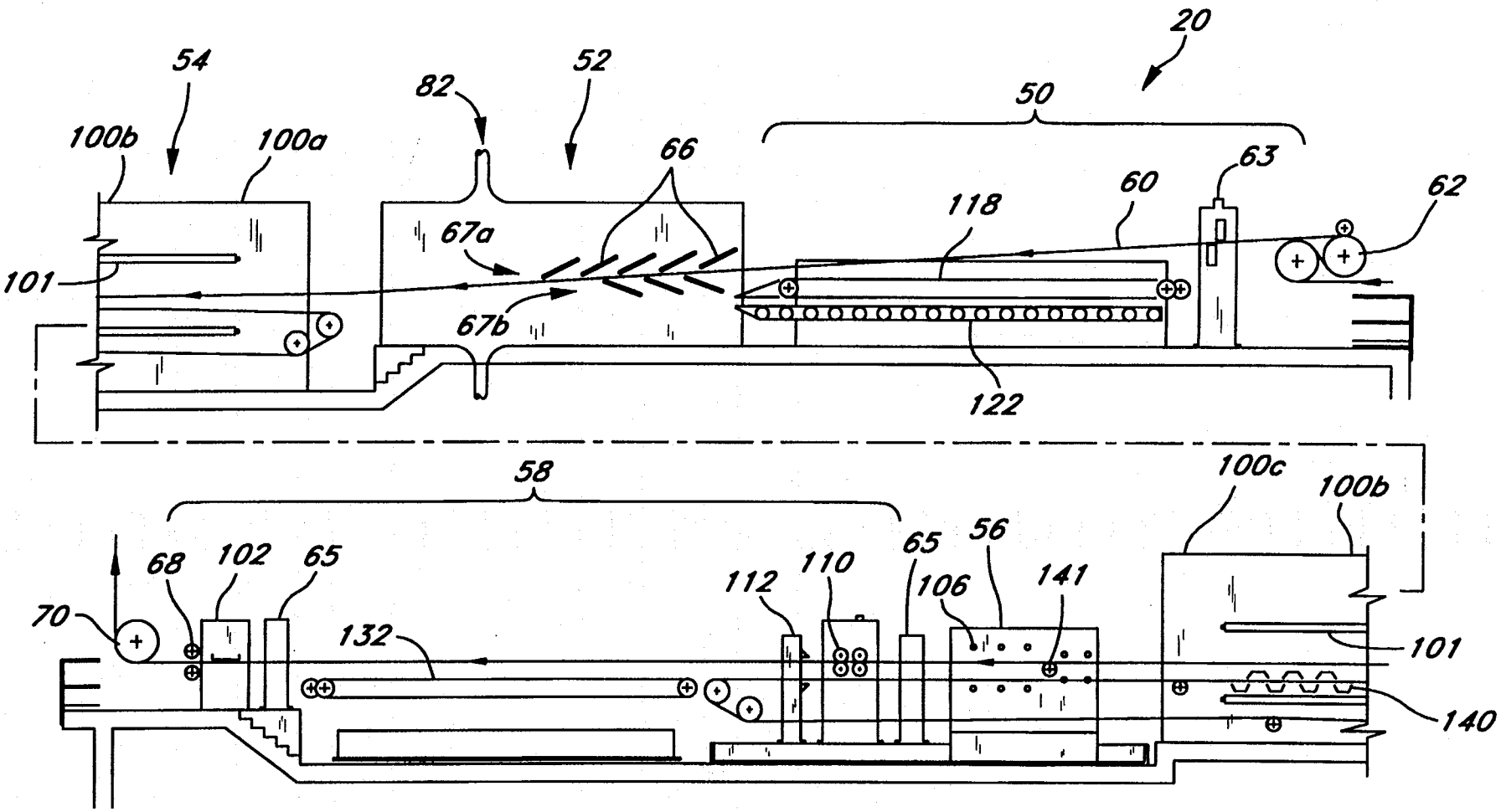
FIG. 9 is a side elevational view of an alternate combined powder coating subsystem of the present invention including a strip flotation system.

In an alternate embodiment, illustrated in FIG. 9, the strip 60 is passed through the oven 100 and powder coating booth 52 in only partial catenary form. In this embodiment, the strip 60 is supported at one end by the rolls 62, and at the other by a suspension element such as one or more flotation nozzles 140 generating high pressure convection air. Such nozzles are well known in the art, and may be placed approximately 4 inches apart on alternating sides of the strip to cause the strip to be supported in a sinusoidal form. In this manner, the strip forms a catenary from its departure at the rolls 62, and then the strip is floated by air pressure along just above the conveyor 128.

In order that the powder not be blown from the strip, the powder on the strip is first melted in a first oven section 100*a*, by means such are pure infrared heat. Only in latter sections of the oven 100 *b,c* is convection added. For example, middle oven section 100*b* may include both infrared and light convective heat sources, and oven section 100*c* may comprise purely high flow convection heat from the flotation nozzles 140. Each of these oven sections 100 *a,b,c* may be physically separated, however, it is most convenient if an "air wall" is used to separate each of the zones in a single oven structure.

One advantage of this embodiment is that the high level of forced air cures the coating quickly. Further, because of the flotation system, the strip can be guided until it is at a level just above the blank conveyor 128. In this position, when the strip exits the oven, it can pass through the same set of quench spray headers 106 and squeegees 110 as blanks, thus eliminating the need for a stack of quench headers and squeegees for each of the strip and blanks. This is accomplished by supporting the strip with rollers 141 which are vertically movable between the cables of the oven conveyor 128 to support the strip through the same quench 56 and drier 110 as used for the blanks.

After the strip 60 passes through the common set of squeegees 110, in this embodiment, the strip can pass over a threading table or repositioning device 65 and then through a joiner 102, a set of rolls 68, and a steering roller 70. One or more vertical repositioning devices 65 may be interposed in the line to assist in threading the strip 60 into the squeegees 110 or joiner 102.

Powder Coating of Blanks

Figure 5:
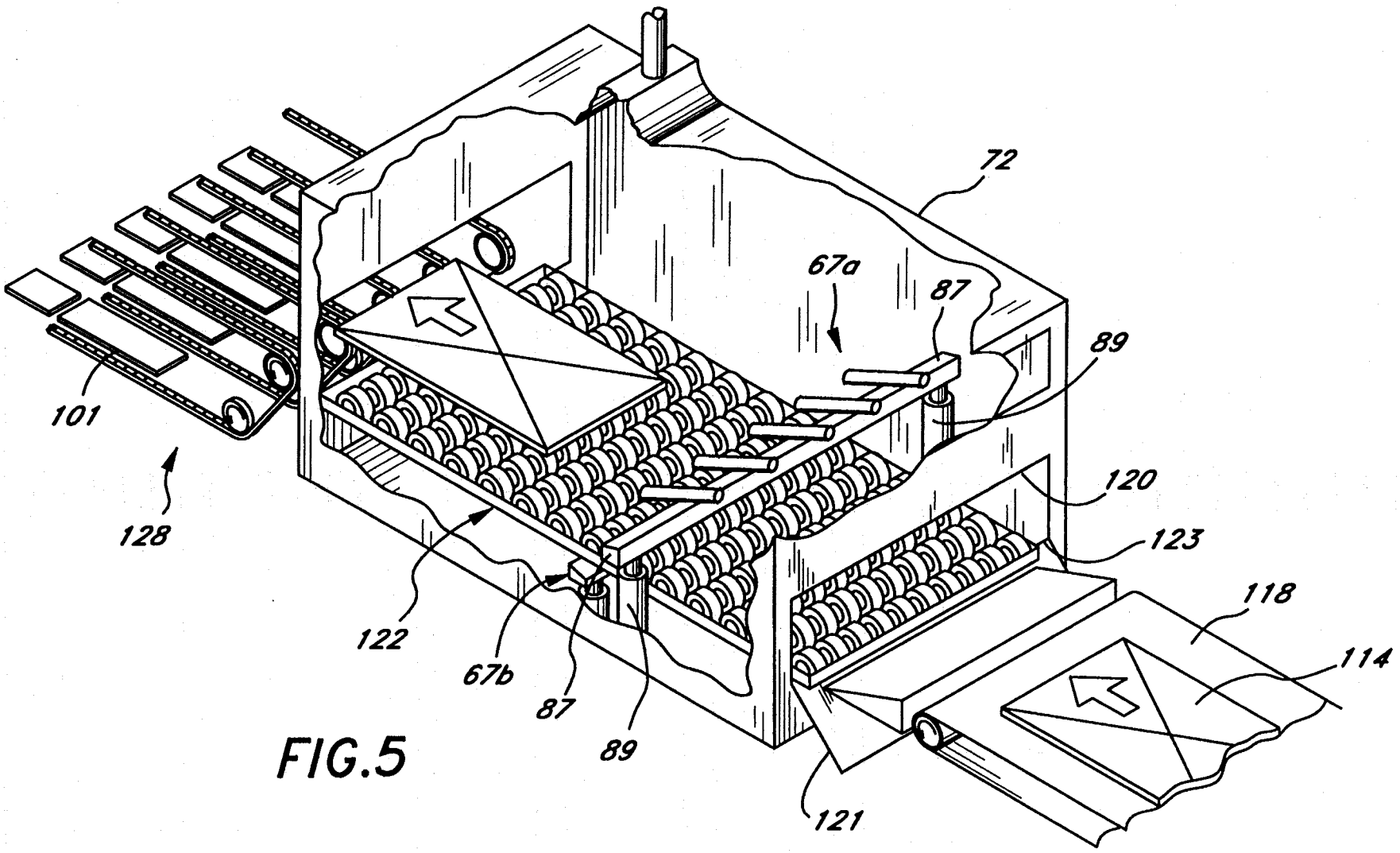
FIG. 5 is a partially cutaway perspective view of the powder coating booth during processing of a series of pre-sheared and punched blanks.

FIGS. 4 and 5 show the process by which presheared blanks 114 are passed through the combined powder coating subsystem 20. The blanks 114 may be solid pieces or may have been pre-punched. As will be described in more detail below, the blanks 114 are initially removed one-by-one from a pallet or unstacker 116 (FIGS. 6*a*–6*d*) and placed on an entrance belt conveyor 118. The belt conveyor 118 travels in a direction which propels the blanks 114 through a blank entrance aperture 120 in the powder coating booth 52. The blank entrance aperture 120 additionally includes a closable door 121 pivoting on an elongated hinge-line 123 for closing the aperture when the powder coating booth 52 is being used to coat coil.

The blanks 114 preferably travel through the powder coating booth 52 on a skate wheel type of conveyor 122. Although not shown, the skate wheel conveyor 122 includes means for urging the blanks 114 through the booth 52. Due to the necessity of placing the blanks 114 on a support surface for transport, only the top side of the blank 114 can be coated. Thus, the lower bank of powder coating application guns 67*b*, which may have been in use for coating the coiled strip 60, is during coating of blanks 114 positioned out of the way in the booth 52 so that only the upper bank of guns 67*a* applies powder to the blanks 114. This back of guns 67*a* utilizes the same guns 66 as those used for coating the coiled strip 60.

In the preferred embodiment, in order to reposition the lower bank of guns 67*b* during blank 114 coating, the lower bank of guns 67*b* is either manually or automatically lowered to a space below the skate wheel conveyor 122. As is illustrated in FIG. 2, the skate wheel conveyor 122 is preferably shifted to the right, out of the powder coating booth 52, to a position underneath the entrance belt conveyor 118 during blank 114 coating operations. When a transition from coil to blank coating occurs, the lower bank of guns 67*b* must be lowered to allow the skate wheel conveyor 122 to be shifted to the left into the powder coating booth 52, as seen in FIG. 4. The upper bank of guns 67*a* is then lowered to a desired position above the skate wheel conveyor 122 for applying powder in a uniform manner to the passing blanks 114. More specifically, the rows of guns 66 in the upper bank 67*a* are slightly downwardly inclined from the row closest to the entrance to the row furthest from the entrance when the booth 52 is being used to coat strip 60, due to the slight angle of the strip catenary. When the conversion to blank coating occurs, all of the upper rows of guns 67*a* are lowered into a substantially horizontal alignment due to the horizontal orientation of the blanks 114. Thus, the row of guns closest the entrance must be lowered the most.

Only one row of guns 66 has been depicted for both the upper bank 67*a* and lower bank 67*b* in FIGS. 2 and 4 for clarity. As mentioned above and shown in FIG. 7, however, there may be more than one, and preferably there are five rows in the upper bank 67*a* and three in the lower bank 67*b*. Each row may be moved independently from the others.

Looking now at FIG. 5, in contrast to FIG. 3, the lower bank 67*b* of powder application guns are positioned underneath the skate wheel conveyor 122. As the preferred embodiment, as stated above, each row of guns is supported on a cross member 87, which is vertically adjustable independently of the other cross members in the other rows using a pneumatic or similar device 89 on either end. However, the preferred embodiment shown is for example only and other arrangements are possible. For instance, the ends of the cross members 87 may be guided within vertical channels, and the vertical adjustment may be accomplished with a small electric motor and gear train (not shown). In another possibility, the powder coating booth 52 may include a plurality of belts and pulleys (also not depicted) for raising and lowering the spray applicator guns 66. Furthermore, the rows of guns, either in the upper bank 67*a* or lower bank 67*b*, may have their movements linked so that the number of prime movers is reduced. For instance, a lever system in which each increment of vertical movement of one row causes a proportional movement of the next row is a possibility.

After the coating step, as seen in FIG. 4, the skate wheel type conveyor 122 moves the blanks 114 through the exit aperture 76 and onto an oven conveyor 128, which is preferably a cable type conveyor as shown in FIG. 4, so as to allow infrared heat elements located below the conveyor to shine through the conveyor 128 when strip is being treated. A roller chain/slat type conveyor may alternatively be used if the location of the elements is changed, or heating on the bottom side of the strip is not necessary. The blanks 114 are conveyed through the oven 54 for the aforementioned melting and curing operation. It is also noted that it may be desirable to allow the infrared heating elements 101 located above the blanks to be lowered closer to the surface of the blanks when switching from strip to blank curing. The lowering of the elements allows for increased heat transfer from the elements to the blanks. The blanks 114 remain on the oven conveyor 128, which extends from the exit end 100*c* of the oven, through a lower portion of the quench 56, and also through a pair of hot air knives 130 for completely drying the blanks.

After drying, the coated blanks are placed on a belt conveyor assembly 132 at the exit end of the powder coating subsystem. This belt conveyor 132 is split longitudinally in the middle, as will be described below, to allow the finished blanks 114 to be dropped onto a stacker 134 underneath.

Blank Input and Output Handling

Now referring to FIGS. 6*a–d*, the process of moving uncoated pre-sheared blanks from the pallet or unstacker 116 through the powder coating subsystem 20, and thereafter onto a stacker 134 is shown. It is noted that there are many types of stackers and unstackers which may be used to accomplished the same results of those described herein. For example, a vacuum type or flotation type stacker may be used. However, the use of a split-conveyor type stacker is described in detail herein.

Figure 6A:
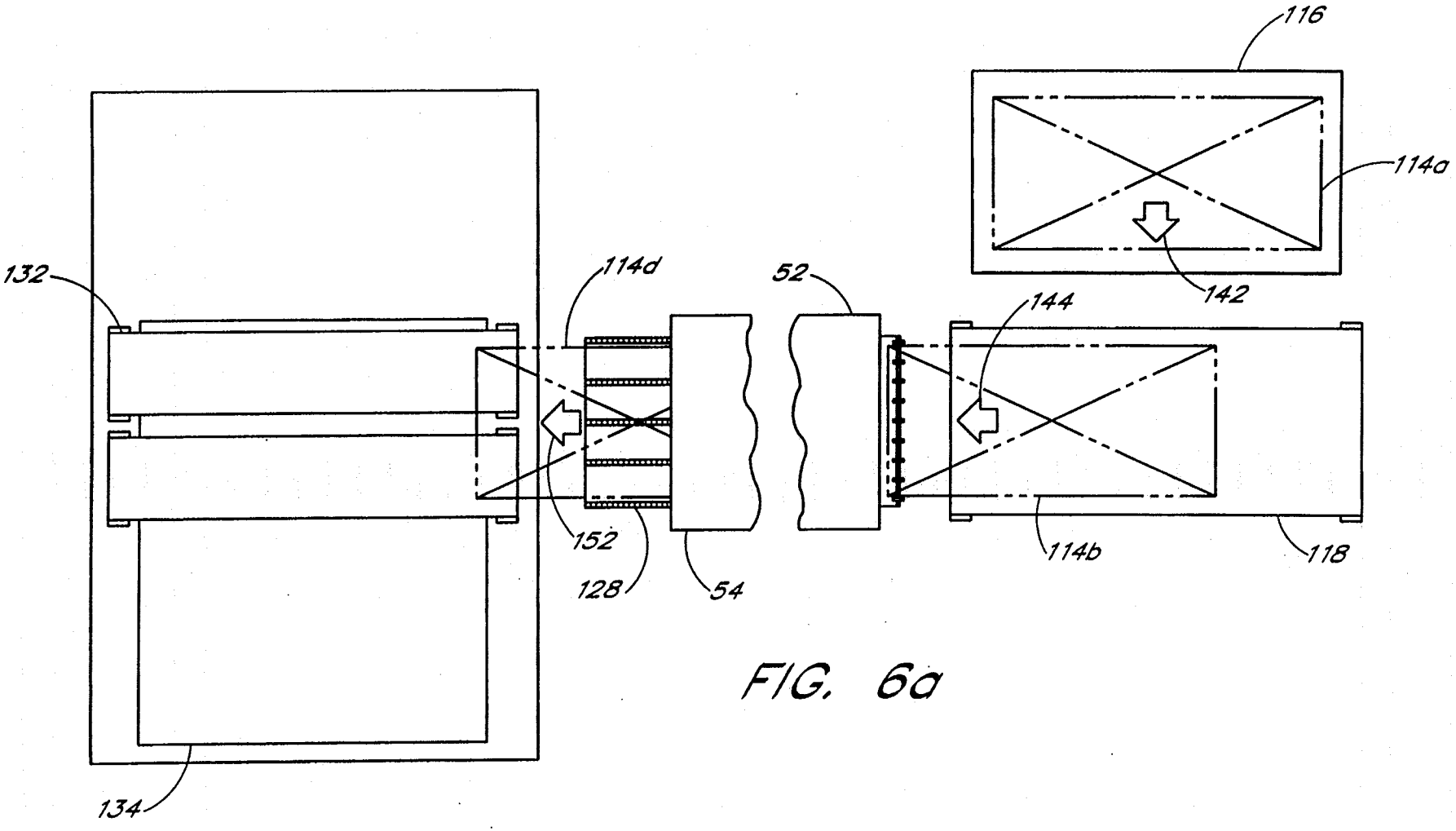
FIGS. 6*a*–6*d* are schematic plan views of the apparatus used for handling blanks at the input and output regions of the combined powder coating subsystem.

In FIG. 6*a*, a single blank 114*a* is removed from the top of a stack of blanks residing on the unstacker 116. The unstacker may be a pallet on wheels or other transportable support structure, which can be moved out of the way when empty to allow placement of a full unstacker. The blanks are transported from the unstacker 116 to the entrance belt conveyor 118, as indicated with arrow 142, by a mechanical handling system (not shown), which preferably has a vacuum suction or similar system such as gripping fingers to lift the first blank. The specific type of mechanical handling system is not critical and is commercially available from several manufacturers. Arrow 144 in FIG. 6*a* illustrates the movement of an earlier deposited blank 114*b* as it begins the process through the powder coating booth 52, and thereafter through the oven 54 while arrow 145 in FIG. 6*b* shows the last blank 114*a* commencing travel into the powder coating booth 52.

Figure 6B:
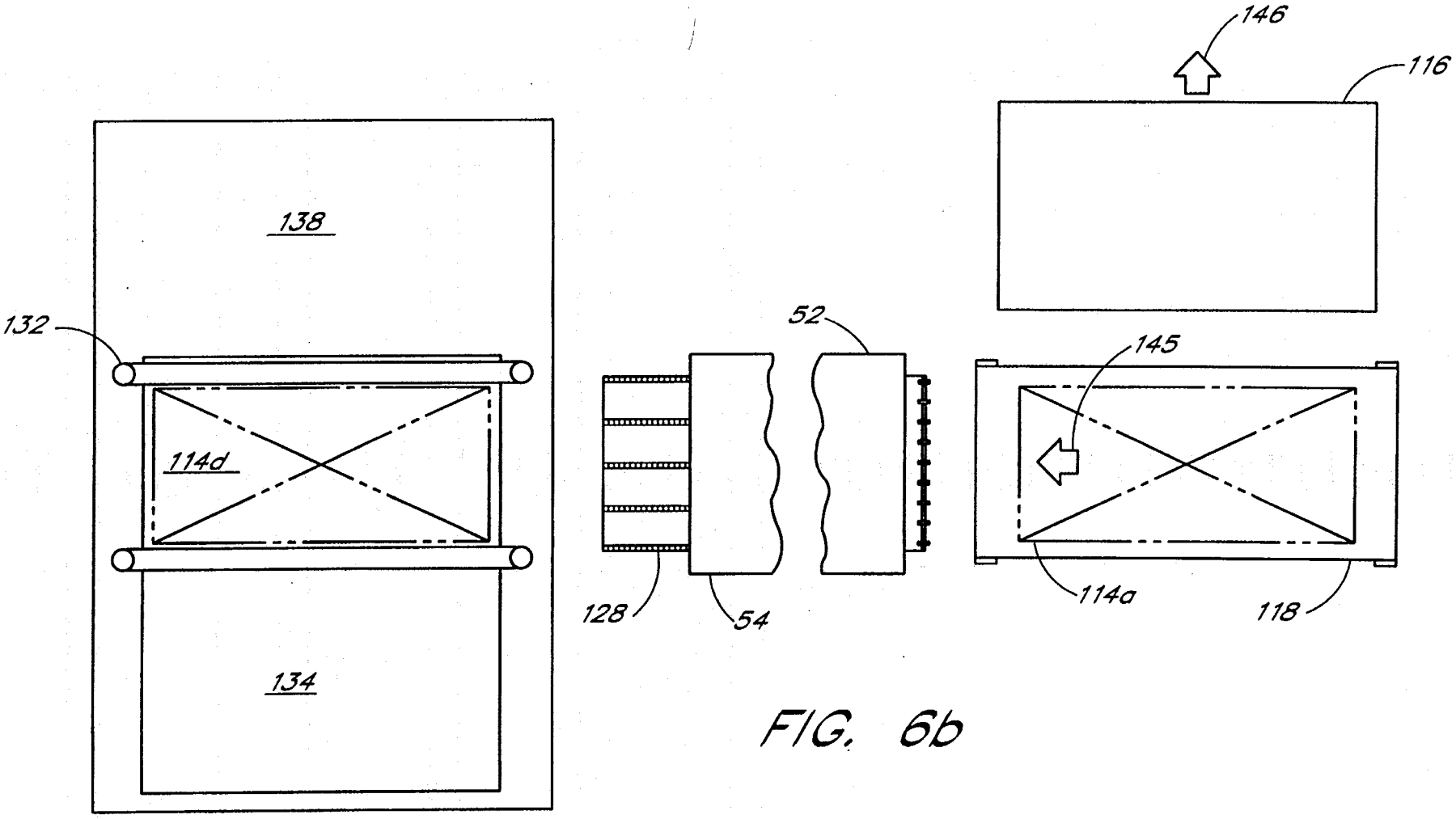
Figure 6C:
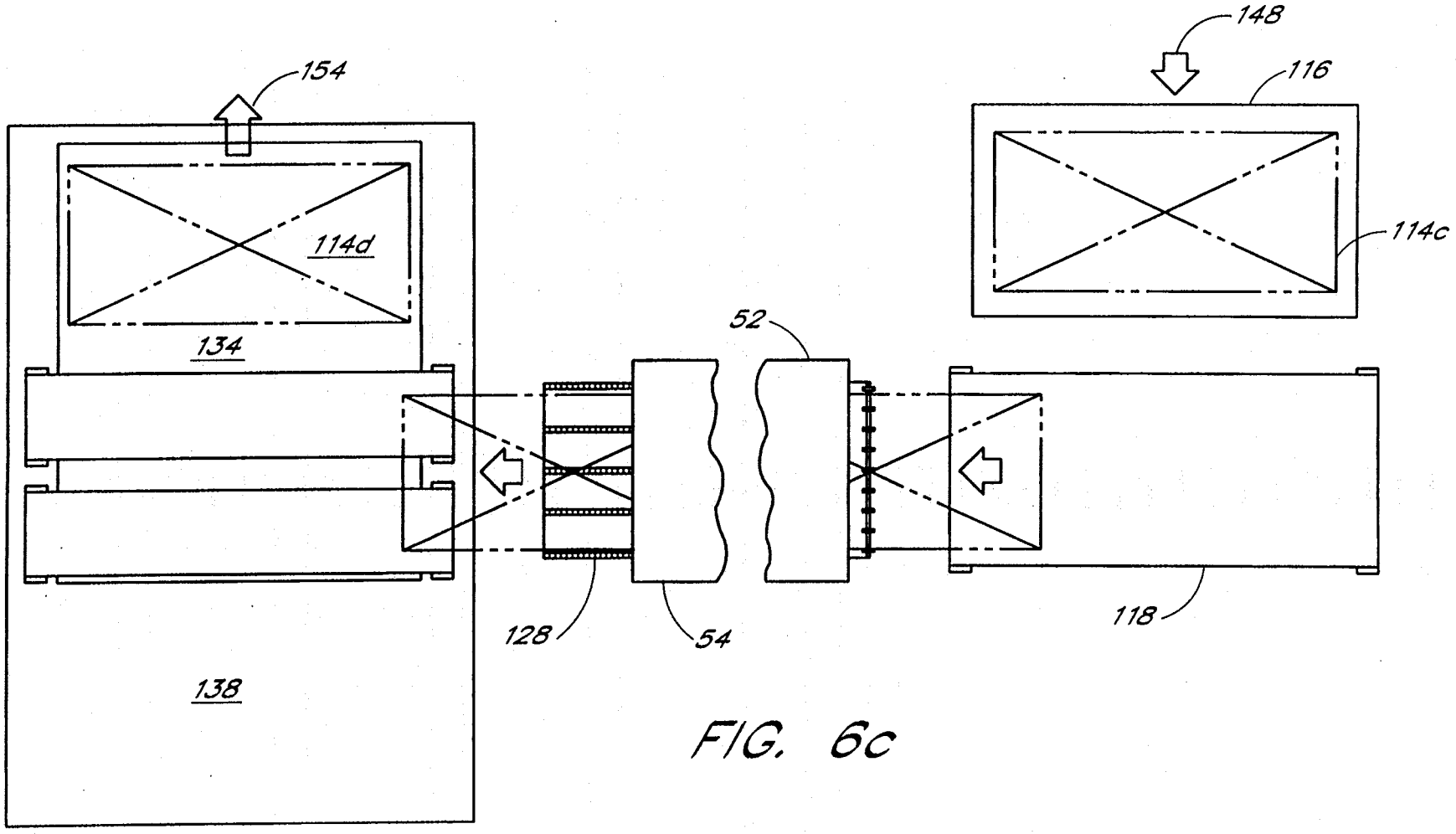
Figure 6D:
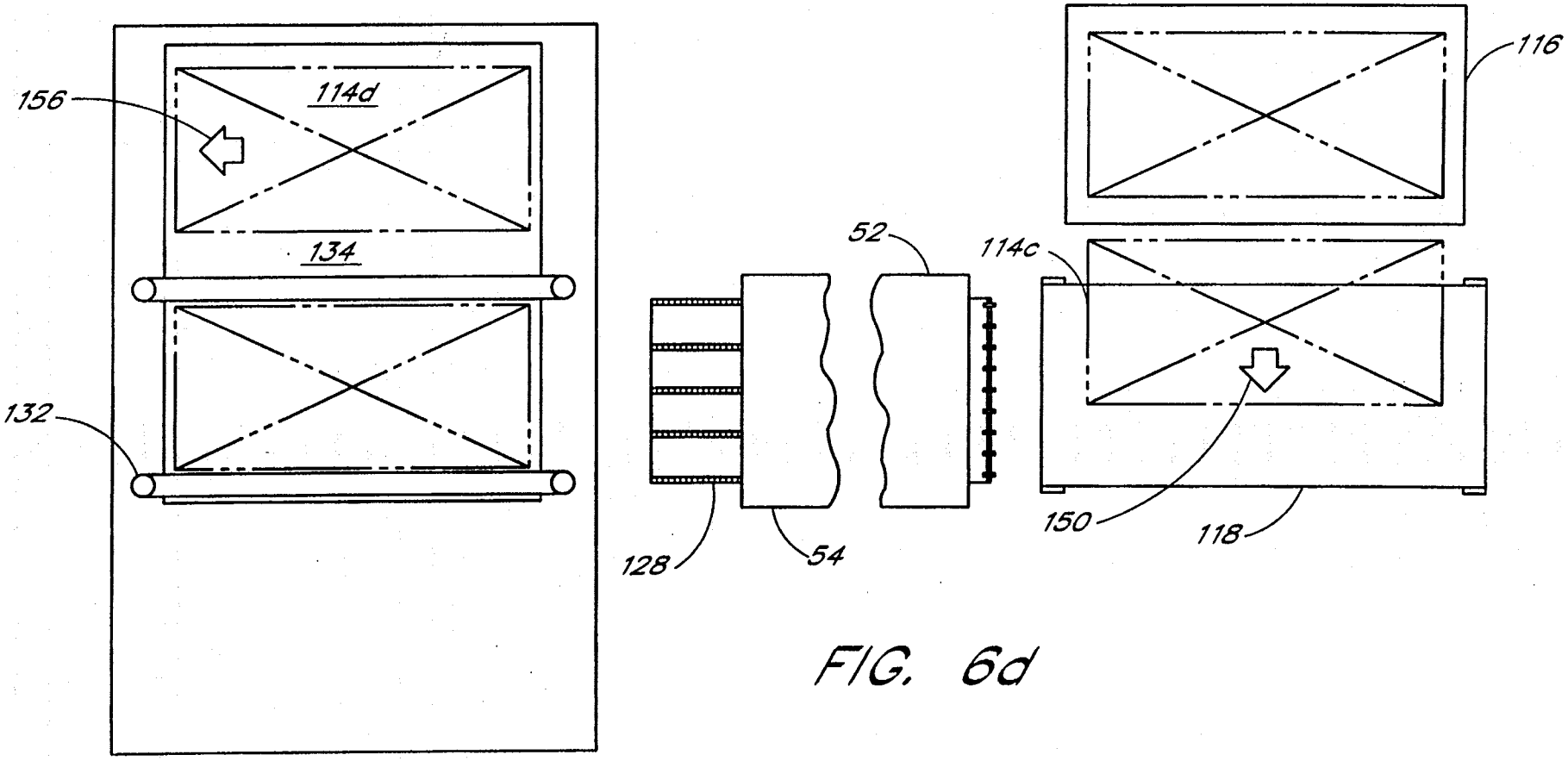

Once a plurality of blanks has been unloaded from the unstacker 116, the empty unstacker is removed, as indicated by arrow 146 in FIG. 6*b*. In FIG. 6*c*, a second unstacker 116' is moved into position next to the entrance belt conveyor 118 for providing further blanks to the powder coating subsystem 20, as indicated at 148. FIG. 6*d* illustrates the process once it has begun all over again, as an uncoated blank 114*c* on the stack of blanks is positioned on the second unstacker 116', as with arrow 150.

Arrow 152 in FIG. 6*a* represents the movement of a coated and cured blank 114*d* exiting the oven 54 onto the exit conveyor 132. In FIG. 6*b*, the coated blank 114*d* is dropped through the exit belt conveyor 132, which is split through the middle. The outer ends of each of the rollers 136 of the split conveyor 132 are hingedly supported so that the center ends of the rollers can be released and the conveyor may open up a gap for finished blanks 114 to fall through onto the stacker 134 below, which is shown in a first position. The stacker 134 may be supported on wheels (not shown) and travel laterally within a well 138 below the output region 58 of the powder coating subsystem 20, the stacker being sized to receive at least two side-by-side stacks of finished blanks 114.

Arrow 154 in FIG. 6*c* shows the stacker 134 being moved to a second position within the well 138. The well 138 is sized so that the stacker 134 can slide transversely therewithin to present an empty space below the split belt conveyor 132. Thus, when a suitable number of coated blanks has been dropped onto a first space of the stacker 134, the stacker moves so that these blanks will be accessible to a finished blank handling system (not shown). As seen in FIG. 6*d*, the coated blank 114*d* is being removed from the stacker as indicated by arrow 156. An empty space on the stacker 134 is now disposed below the split conveyor 132 to receive further coated blanks.

The mechanism for moving the stacker 134 is of a conventional type and may be actuated manually at the appropriate time or automatically, depending on the sophistication of the system. For example, the system may have sensors to determine how many times the split conveyor 132 drops blanks to the stacker 134. In another arrangement, one or more LED/photosensor combinations may be positioned underneath the split conveyor 132 to detect the height of the stack of coated blanks. After a predetermined number of blanks has been deposited, or the height of the stack of coated blanks reaches a predetermined value, a control system (not shown) may signal the stacker 134 to move and present the empty space underneath the split conveyor.

In other processing lines, the present combined powder coating subsystem may feed the blanks 114 to a post-processing region, similar to that shown for coil in FIG. 1. In fact, the present powder coating subsystem can be sold and installed as a stand-alone unit for coating pre-treated coil or blank only, without any pre- or post-coating operations. The capability of switching from coil to blank coating processing is a great advantage for coating manufacturers in this highly competitive field. The two-in-one powder coating apparatus thus substantially reduces initial costs for a manufacturer. The invention combines the advantages of coil-to-coil high speed operation of strip processing during powder coating and curing with all of the advantages of full powder coverage of blanks using the same powder coating and curing of apparatus. In short, the system allows a manufacturer to quickly adapt to changing customer and market demands.

SUBSTRATE CONVERSION

In order to convert from the processing of coil strip to the processing of blanks, a "night strip" is attached to the trailing end of a coil strip and fed through the coating subsystem 20. This prevents the necessity of having to rethread a coil 60 through the entire system, which operation would normally take several hours.

In order that the strip not interfere with the blank coating operations in the subsystem 20, the night strip is halted and sheared at a shear 63 (FIGS. 2 and 4) adjacent the entrance rolls 62, whereby a first portion is created which continues through the powder coating booth 52 and oven 54. This portion of the night strip is stopped at the joiner 102 between the oven and the quench 56. Next, preparations for the blanks are made. In particular, an unstacker 116 is brought into proximity of the belt conveyor 118. The powder coating application guns 66 then are adjusted from their coil coating position to their blank coating position, with the lower bank 67*b* descending to below the level of the skate wheel conveyor 122. The skate wheel conveyor 122 is then shifted from under the belt conveyor 118 into the powder coating booth 52. Finally, the speed of the oven conveyor is modified to match the slower speed at which blanks are to be coated, whereupon blanks are then fed into the powder coating subsystem to be processed along the series of conveyors. Lastly, if desired, the position of the infrared heating elements 101 may be adjusted so as to increase the heat transfer rate. The entire conversion requires only these few aforementioned steps, which all may be automated and controlled by a computer.

Further, it is noted that in the alternate embodiment illustrated in FIG. 9, the night strip is fed through and left in place at pinch rolls 68 near the steering roll 70, as opposed to after the oven 100. In this manner, when blanks are passes through the subsystem, the strip does not interfere during the quenching and drying steps.

In the reverse situation, in order to change from the processing of blanks 114 to the processing of coil 60, the last blank 114 is allowed to exit the oven 54 and quench 56. The second portion of the night strip, previously held at the entrance rolls 62, is then fed along the conveyors until just prior to the joiner 102, where it is lifted up by a vertical repositioning device 65 and joined with the trailing end of the first night strip portion. The joiner 102 operates to crimp the trailing and leading ends of the first and second portions of night strip, respectively. In one type of joint, a lock seam is formed with interlocking portions pressed together. In another configuration, a button seam, comprising a plurality of dimples punched in overlapping strip, is used.

The exit pair of pinch rolls 68 adjacent the joiner 102 provides the moving force for the strip 60 during joining operations. Specifically, the first portion of the night strip, which is left severed at the joiner 102, may have to be positioned forward or backward within the joiner by the pinch rolls 68. These pinch rolls 68 are then disengaged during the coating process.

Once joined, the strip 60 is tensioned to an appropriate level to raise it off the conveyors, the skate wheel conveyor 122 is retracted from the booth 52, and the powder coating application guns 66 are adjusted to conform to the catenary shape of the strip. In summary, the conversion from coil to blank processing, or vice versa, is relatively simple and may be facilitated by automatic controls.

As illustrated in FIG. 9, when using the alternate flotation system, the strip 60 can be fed through the entire system on the conveyor 128, raised if necessary to enter the squeegee rolls 110 (if the rolls are not readily retractable), and raised to enter the joiner 102 at the end of the subsystem for rejoining to the night strip.

The speed of coating strip 60 is substantially greater than the maximum speed possible for coating blanks 114. This is due to the fact that the unstacking and stacking steps, depicted in FIGS. 6*a–d*, limit the maximum speed of the entire line. The intensity or flux of heat applied by the heating means within the oven 54 must be adjusted for different speeds of the line. Specifically, the heat intensity or flux is reduced for the slower processing speed of blanks 114 and increased accordingly for the faster processing speed of coil 60. The net result is an equivalent melting and curing cycle.

Coating Line Operations

Figure 8:
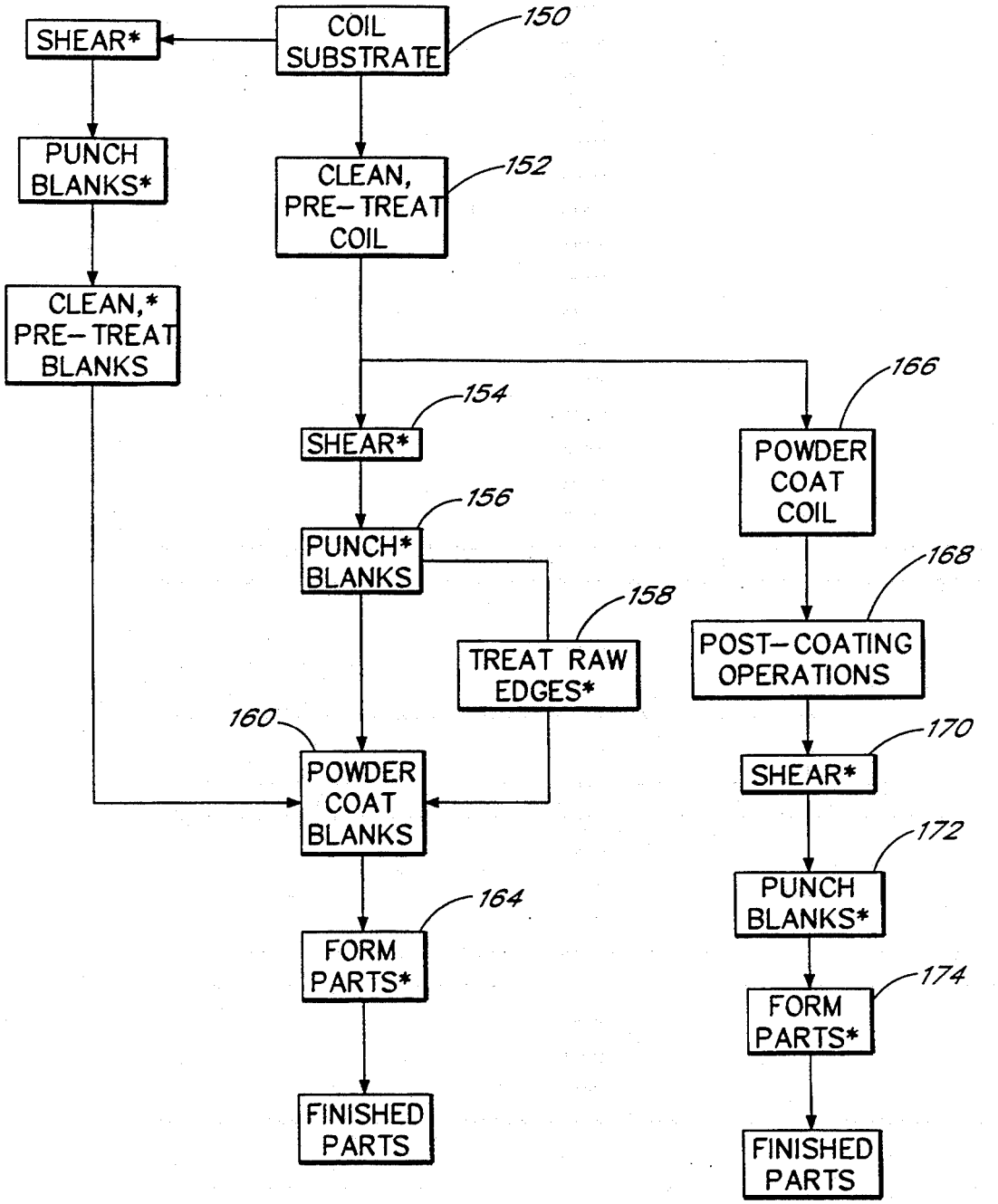
FIG. 8 is a flowchart depicting the various processing steps used in the present invention for coating either coil or blanks.

FIG. 8 is a flowchart which schematically depicts the operations during both the coil coating and blank coating utilizing the powder coating subsystem 20 of the present invention. The pre-treating operations shown in FIG. 1 may be accomplished, as shown in boxes 150 and 152, provided that the coating manufacturer has the proper equipment. Thus, step 152 is optional. Looking at the left branch of the flowchart, the shearing and punching operations, depicted in boxes 154 and 156, respectively, may be done in-house or by a separate manufacturer. Prior to the powder coating step, the punched presheared blanks may have their raw edges treated, as at 158, as an option. Partially or completely treated blanks are then input into the powder coating subsystem 20, shown in box 160. Again, provided that the manufacturer has the proper equipment, post-coating operations may be performed in box 162. The finished blanks are then formed into parts in box 164, which may also be done on- or off-site.

On the right branch, the raw or pre-treated coil is input into the powder coating subsystem 20 at box 166. Again, optional post-coating operations may be performed in box 168. At this point, the coated coil is further processed in-house or sold as is. The processing steps are shown in boxes 170, 172 and 174. In both branches of FIG. 8, the asterisks indicate processes which may be completed in-house or by a separate manufacturer.

Although this invention has been described in terms of certain preferred embodiments, other embodiments that are apparent to those of ordinary skill in the art are also within the range of this invention. Accordingly, the scope of the invention is intended to be defined only by reference to the claims.

We claim:

1. A method of coating metal in strip and then in blank form, comprising:

supplying a continuous strip of metal through an entrance shear to an entrance end of a powder coating booth;

suspending said continuous strip through said powder coating booth and through an oven;

coating both sides of said strip using powder coating spray guns within said coating booth;

melting and curing the powder on both sides of said strip within said oven;

halting the progression of said strip;

shearing said strip at said entrance shears and allowing a first end of said sheared strip to travel through said coating booth and said oven to a joiner;

displacing a conveyer from a location outside of said coating booth to a location between an upper bank and a lower bank of powder coating spray guns within said coating chamber;

introducing a blank to a location between said entrance shear and said entrance end of the coating booth;

propelling said blank onto said coating booth conveyor;

coating said blank using said upper bank of powder coating spray guns; and propelling said blank on an oven conveyor through said oven to melt and cure the powder on said blank.

2. The method of claim 1, comprising lowering said lower bank of powder coating spray guns below the level of said coating booth conveyor.

3. The method of claim 1, comprising delivering said coated blanks to a split conveyor after said oven, said split conveyor being configured to drop said coated blanks onto a stacker for removal from said coating line.

4. The method of claim 1, comprising cooling both strip and blanks within a quench located after said oven.

5. The method of claim 1, comprising suspending said strip within said oven using air flotation nozzles.

6. The method of claim 1, comprising:

halting the introduction of blanks to said powder coating booth;

advancing a second end of said strip from said entrance shear through said powder coating booth and said oven on said coating booth conveyor and said oven conveyor, respectively;

vertically repositioning said second end upward to said joiner;

joining said first end and said second end of said strip to form a continuous strip;

displacing said coating booth conveyor out of said coating booth; and advancing said continuous strip powder coating line.

* * * * *

UNITED STATES PATENT AND TRADEMARK OFFICE

CERTIFICATE OF CORRECTION

PATENT NO. : 5,439,704
DATED : August 8, 1995
INVENTOR(S) : Sankaran, et. al.

It is certified that error appears in the above-indentified patent and that said Letters Patent is hereby corrected as shown below:

Column 1, line 21, change "for driving through" to --for driving the solvent or water out of the coating and to cure the paint through--.

Column 3, line 67, change "removal. preferably" to --removal. Preferably--

Column 5, line 4, change "roll Other" to --roll 44. Other--

Signed and Sealed this
Sixth Day of May, 1997

*Attest:*

*Attesting Officer*

Bruce Lehman

BRUCE LEHMAN

*Commissioner of Patents and Trademarks*